US005334098A

United States Patent [19]

Pope et al.

[11] Patent Number: 5,334,098

[45] Date of Patent: Aug. 2, 1994

[54] PLAYGROUND DEVICE

[75] Inventors: Rodney T. Pope, Cherryville; Steven D. Barber; Daniel R. Hall, both of Charlotte, all of N.C.

[73] Assignee: Specialty Products Incorporated, Charlotte, N.C.

[21] Appl. No.: 22,444

[22] Filed: Feb. 25, 1993

[51] Int. Cl.[5] ..... A63B 9/00

[52] U.S. Cl. ..... 472/116; 482/35

[58] Field of Search ..... 472/116; 482/35, 36, 482/37, 148; 52/652.1, 653.1; D21/241-245

[56] References Cited

U.S. PATENT DOCUMENTS

| | | | |
|---|---|---|---|
| D. 224,796 | 9/1972 | Price et al. | D21/245 |
| D. 235,902 | 7/1975 | Zick | D21/245 |
| 3,814,416 | 6/1974 | Munger et al. | 482/36 |
| 4,159,112 | 6/1979 | O'Brian et al. | 482/36 |
| 4,343,464 | 8/1982 | Dose | 472/116 |
| 4,369,965 | 1/1983 | Ahrens | 482/35 |
| 4,546,965 | 10/1985 | Baxter et al. | 482/35 |

*Primary Examiner*—Carl D. Friedman
*Assistant Examiner*—Kien Nguyen
*Attorney, Agent, or Firm*—Olive & Olive

[57] ABSTRACT

The invention provides a children's playground device to be used for climbing up and sliding down. The device is configured in the form of a pyramid, having a multi-sided base and planar surfaces extending upwardly and inwardly to a top pad at the center. Alternate planar surfaces are adapted for climbing with padded, irregular surface treatments, and intermediate planar surfaces are adapted for sliding down with low friction smooth surface treatments. A resilient pad is supplied around the base to cushion the downward impact of users of the device. A further embodiment is configured as a semi-pyramid and is adapted to be placed against a wall or partition.

9 Claims, 3 Drawing Sheets

PLAYGROUND DEVICE

BACKGROUND OF THE INVENTION

1. Field of the Invention

This invention relates to playground equipment for use by children, and particularly to playground equipment of the type used for climbing up and sliding down.

2. Description of the Related Art

Playground equipment has been expanding in scope of design in recent years, including a trend to utilize colorful plastic and cushioned components which are attractive and are less likely to cause injury to the child user than the predecessor equipment having its principal components of metal. These contemporary, plastic and foam component equipped playgrounds are typically associated with family oriented restaurants and are useful in part to draw children, accompanied by adults, to the eating facility.

The popularity of this type of equipment formed with plastic components is due in large measure to the interesting and colorful designs used and in part to the fact that softer surfaces allow greater play flexibility.

It is therefore an object of this invention to provide a playground device which utilizes the popular soft, colorful plastic and fabric materials in a unique configuration.

It is an additional object of this invention to provide a playground device which may be variable and versatile in form.

Other objects and advantages will be more fully apparent from the following disclosure and appended claims.

SUMMARY OF THE INVENTION

The present invention provides a novel climbing and sliding device adapted for use by children in a playground. The overall upper configuration of the invention device is pyramidal, having four major triangular sides and four intermediate rectangular portions. The triangular sides are formed with surface irregularities which are cushioned and fabric covered and provide toeholds for climbing. The intermediate rectangular portions are covered with a smooth, slippery sheet adapted for sliding. All eight surfaces are inclined. At the apex of the pyramid shape is a cushioned and fabric covered top pad which functions as a platform. Around the entire base of the pyramid shape is a resilient base pad. Devices made according to the invention may be built with various numbers and shapes of sides and with widely varying configurations of surface irregularities.

DETAILED DESCRIPTION OF THE INVENTION AND PREFERRED EMBODIMENTS THEREOF

Figure 1:
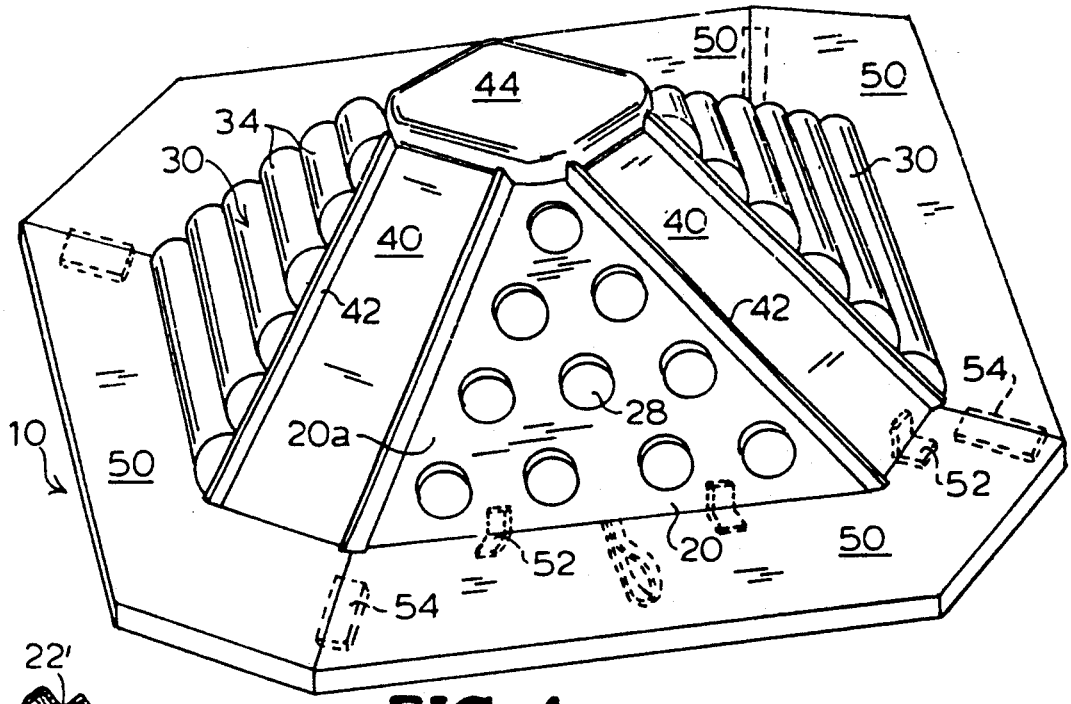
FIG. 1 is a perspective view of the playground device of the invention.
Figure 3:
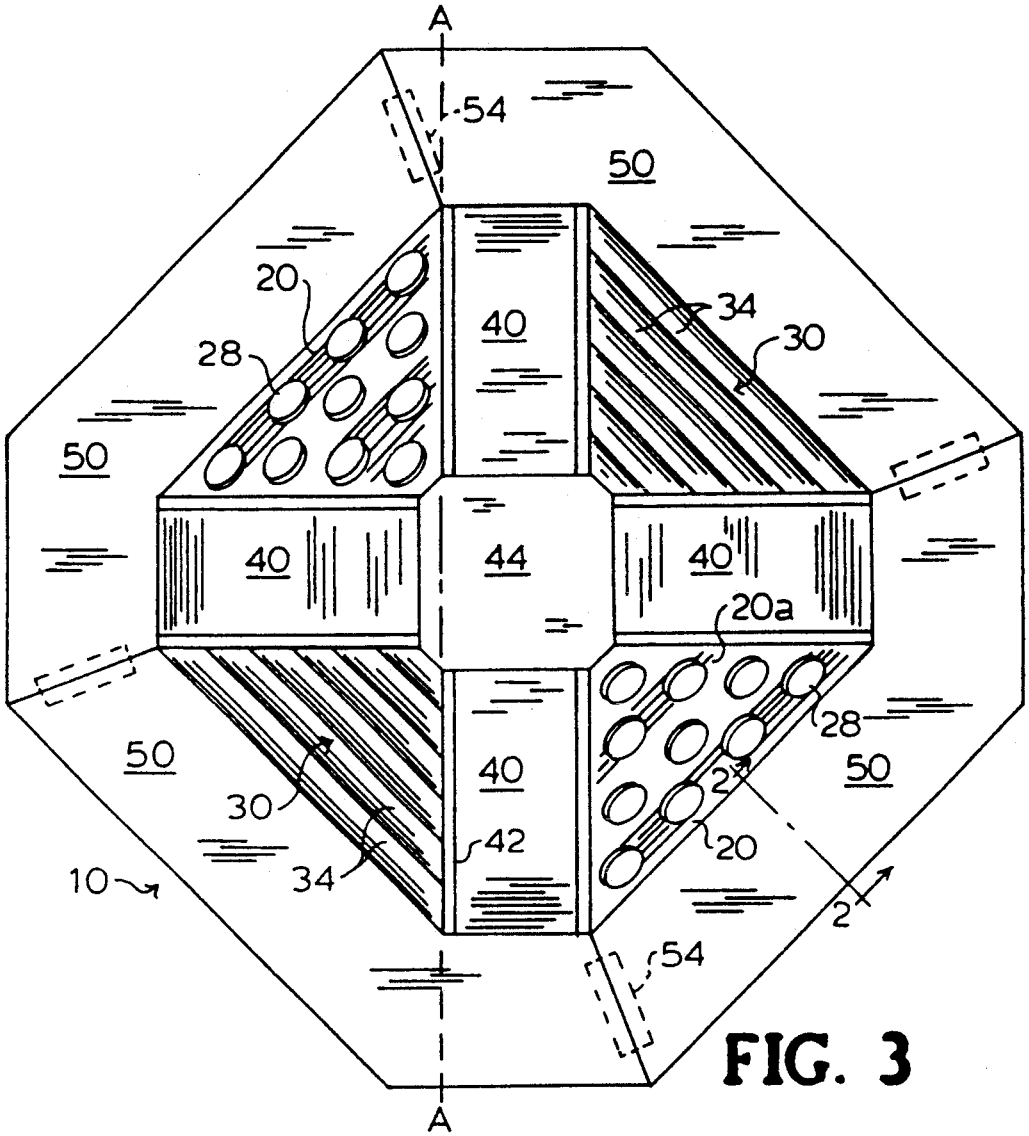
FIG. 3 is a top plan view of the playground device of the invention.
Figure 2:
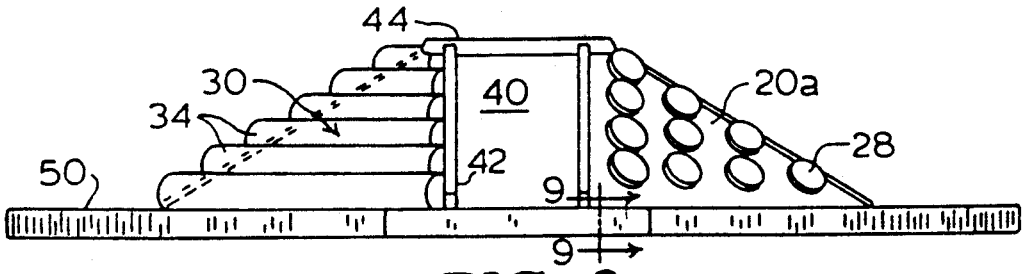
FIG. 2 is a side elevation view of the playground device of the invention.

As briefly described above, the invention device 10 is formed essentially as a modified pyramid, having four convergingly inclined triangular sides 20, 30 as well as four convergingly inclined rectangular sides 40 illustrated in FIGS. 1, 2, 3. The four triangular sides 20, 30 are preferably configured as isosceles triangles with surface irregularities 28, 34 to enable climbing up to a centrally located top pad 44 at the apex of the pyramid. In use, the child climbs up the irregularly surfaced triangular sides to reach the top pad 44. Top pad 44 is an assembly of a resilient foam cushion over a substantially rigid platform, both cushion and platform being covered by a colorful vinyl laminated fabric. After attaining access to top pad 44, the child can then slide down any slide 40 to land on resilient, foam cushion formed, base pad 50, positioned and constructed to afford a soft landing.

Each slide 40 is bordered by raised edge rails 42 on either side thereof. Base pad 50 is connected to the frame of the playground device (see FIGS. 4, 5, 9) by straps 52 to prevent movement. Base pad 50 is built in several sections which are held together by means of hook and loop (Velcro ®) type fastening strips 54 having mating components at the adjoining edges of base pads 50. The principal, exposed parts of the playground device are made of colorful plastic or are cushioned and covered with a colorful fabric.

Figure 10:
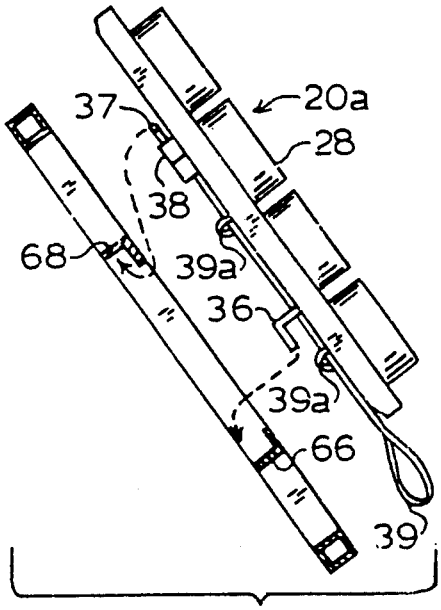
FIG. 10 is a sectional exploded view of a portion of the frame of FIG. 5 and the panel of FIG. 6 illustrating the mounting arrangement therefor.

In the embodiment illustrated, each triangular side 20 has disk shaped surface irregularities 28 (see FIGS. 1, 6, 7) and each triangular side 30 has semi-cylindrical shaped irregularities 34 (see FIGS. 1, 2, 10). Many other styles of panel surface irregularity may be employed.

FIG. 3 shows a top plan view of the invention device 10, especially the base shape of the playground device. Base pad 50 is seen peripherally secured around playground device 10. Base pad 50 is formed of a plurality of segments for ease of assembly.

Figure 4:
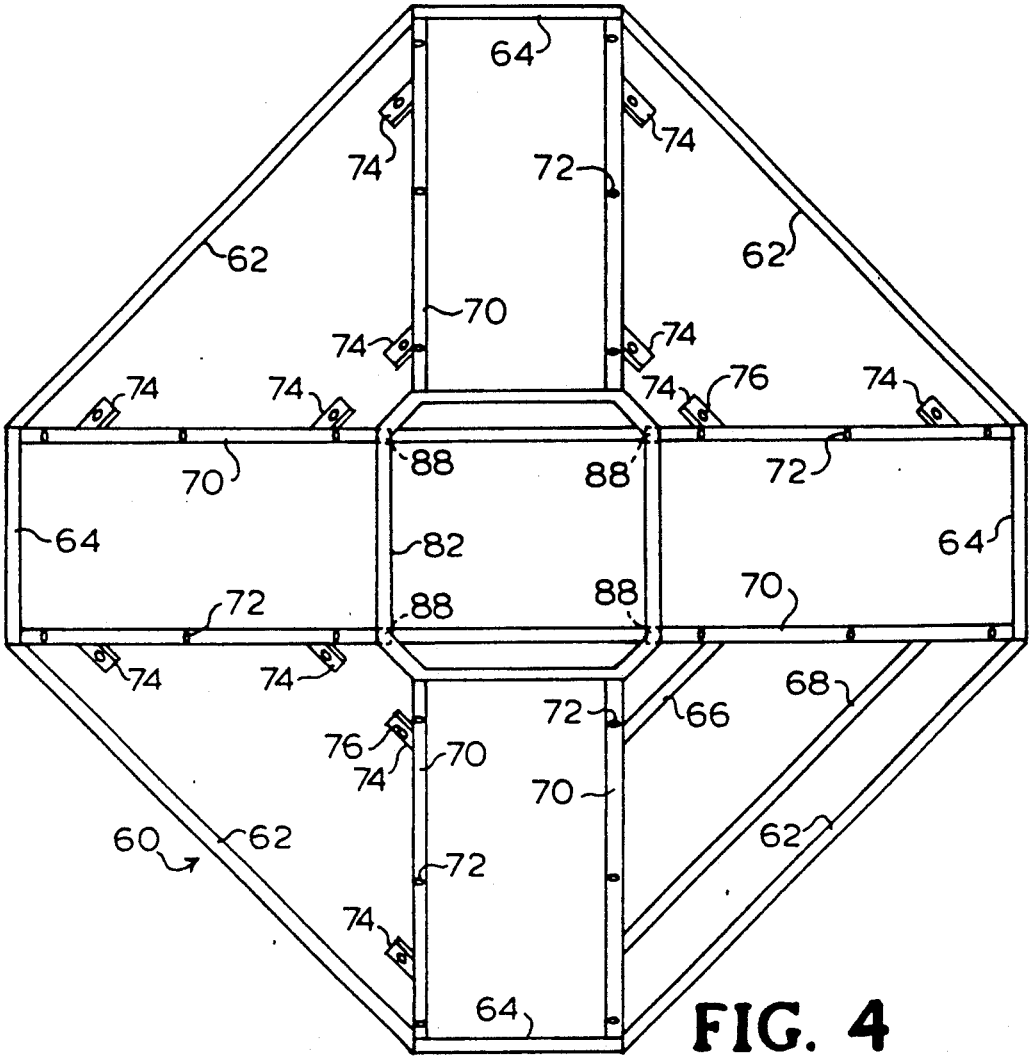
FIG. 4 is a top plan view of the frame of the invention.
Figure 5:
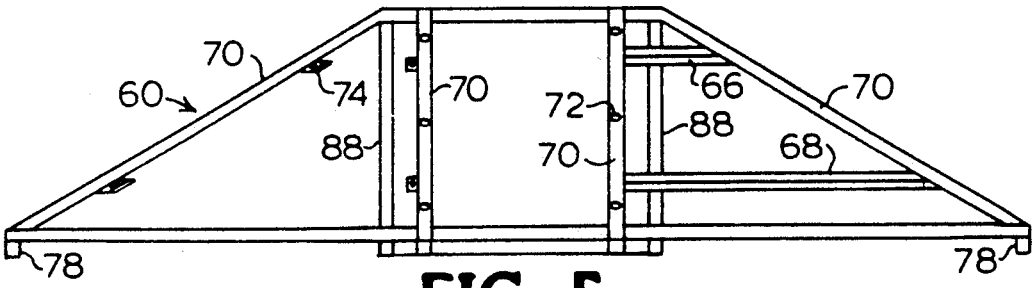
FIG. 5 is a side elevation view of the frame of the invention.

The frame 60 of the playground device 10 of the invention is illustrated in FIGS. 4, 5, having the same basic shape as that seen in FIG. 3. Frame 60 is substantially symmetrical, with the exception of added bars 66, 68 in one quadrant thereof. The function of bars 66, 68 is described below. Frame 60 is preferably made of metallic tubular square members which are fixedly attached together by welding in the preferred embodiment.

The triangular openings in frame 60 are separated from the rectangular openings by a series of converging, inclined bars 70. The outside ends of bars 70 connect to triangle periphery bars 62 and the inside ends connect to top pad frame 82. The outside ends of bars 70 are also connected to rectangle end bars 64 at the same position as where they are connected to triangle periphery bars 62, thus completing the eight-sided modified pyramid shape.

All eight inclined bars 70 each have a series of formed holes 72 adapted to match the position of screws provided in all slide panels 40 to be mounted thereon. Six bars 70 are equipped with support tabs 74 each having a screw-receiving hole 76 positioned to match screws provided in three of the four triangular sides 20, 30 (FIGS. 1, 2, 3). Support tabs 74 are angled to be flush with the mating lower surfaces of triangular sides 20, 30. The fourth triangular side 20*a* is mounted at the quadrant containing bars 66, 68 by means of a hook and latch to be described below.

As shown in side elevation, frame 60 additionally contains short peripheral legs 78 and long central legs 88 which are oriented vertically. As seen in FIG. 4, legs 78, 88 are positioned so as to securely support all panels of the invention.

Figure 7:
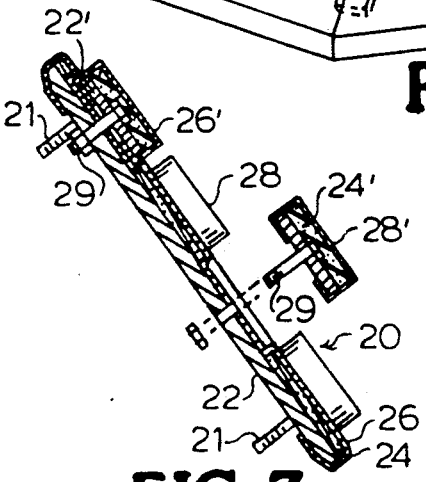
FIG. 7 is a sectional view through the climbing panel of FIG. 6 taken in the direction of line 7—7.
Figure 6:
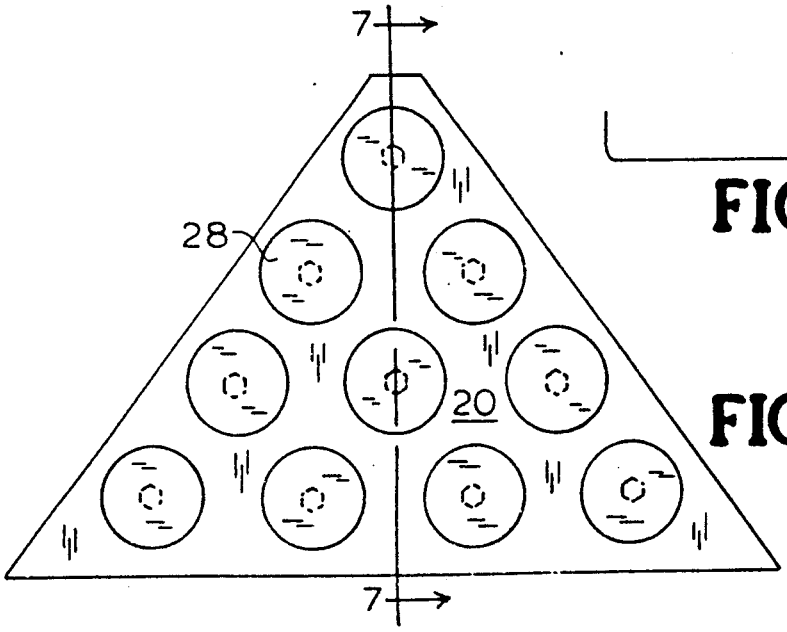
FIG. 6 is a view of a climbing panel of the invention as seen perpendicular to the plane of the panel.

Having described the overall device of the invention, attention is directed to FIGS. 6 and 7 which portray one embodiment of a triangular side 20. In FIG. 6, a view of triangular side 20 is portrayed as seen perpendicular to the panel surface. A series of cushioned disks 28 are mounted on the surface so as to create stepping blocks to facilitate climbing.

The construction of triangular side 20 and disks 28 is shown in section in FIG. 7 with one disk 28' positioned for mounting. Triangular side 20 is constructed of base board 22, foam padding 24 and fabric covering 26. The fabric used is preferred to be a vinyl coated material for weather resistance and strength. Disks 28, 28' are similarly constructed with base board 22', foam padding 24' and fabric covering 26'. Each disk 28 is provided with a bolt 29 adapted to fit a mating hole in base board 22. A series of cavities 25 are formed in foam padding 24 with fabric covering 26 pressed into these formed cavities 25 to receive and partially surround each disk 28. Triangular side 20 is provided with a series of bolts 21 positioned to fit mating holes 76 in frame 60 (FIG. 4).

An alternate form to side 20 of FIG. 6 is side 30, as shown in FIGS. 1, 2, 3. Side 30 comprises a similar base board construction to that of side 20 and is covered in a fabric. A number of substantially identical roll steps 34, each filled with a resilient foam material, are mounted to the base platform 32 to form a ridged, continuous surface.

Figure 8:
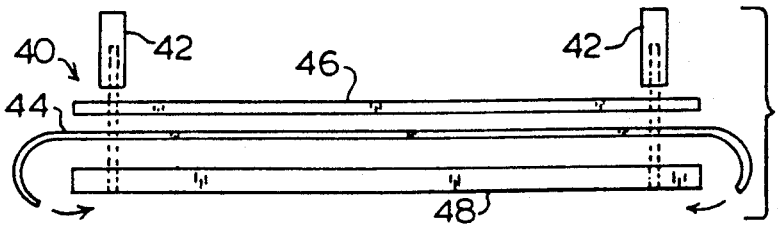
FIG. 8 is an exploded end view of a sliding panel of the invention.

Intermediate each pair of adjacent triangular sides 20, 30 is a slide 40, illustrated in exploded end view prior to assembly in FIG. 8. Slide 40 is preferably a composite of three layers in fixed contact: base platform 48, fabric covering 44 wrapped around platform 48 in protective manner and low frictional plastic top layer 46, all having matched bolt holes along opposite edges thereof. A rail 42, having counterbored bolt holes is mounted along each long edge of slide 40. The holes in the slide 40 components 42, 44, 46 and 48 are positioned to align with holes 72 in inclined frame bars 70 (see FIG. 4).

Figure 9:
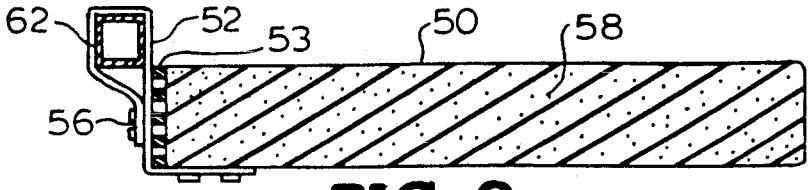
FIG. 9 is a sectional view of the resilient pad assembly as taken in the direction of line 9—9 of FIG. 2.

As mentioned, a cushioned base pad 50 is secured along the lower periphery of playground device 10, as shown in section view in FIG. 9. Base pad 50 is comprised of a resilient core 58 covered with a vinyl coated fabric including a perforated ventilator strip 53 along an edge adapted to face toward frame 60 and relieve air pressure. Strap 52 is affixed to base pad 50 and has snap 56 located to be secured to frame member 62.

Referring to FIG. 10, all triangular sides 20, 30 panels are fitted with bolts to assemble to frame 60 except the last panel, shown here as side 20*a*. The bolts of other triangular sides 20, 30 are arranged to be locked with nuts from below, thus the last panel is to be mounted differently. Triangular side 20*a*, indicated to be the last panel to be mounted on frame 60, has a frame hook 36 and a spring-biased frame latch 38 secured to its underside in locations respectively suited to mate with frame bar 66 and frame bar 68. A further accommodation is strap 39 affixed to latch 38 and tunnelled through loops 39*a* to terminate beyond the lower edge of panel 30. In assembly, frame hook 36 is placed over frame bar 66 and the tongue 37 of latch 38 is retracted by pulling strap 39 and then brought into engagement with frame bar 68. When it is necessary to remove panel 30 so as to access that or other panels of the playground device, strap 39 is pulled to disengage tongue 37 of latch 38 and remove the panel 20*a*.

A further embodiment of the present invention provides a plurality of inclined planar surfaces arranged in a substantially semi-pyramid unit so as to be placed with its diametral plane against a wall or partition. This half-size climbing and sliding device offers the activities of the full model, but requires only half the floor space. Such a semi-pyramid unit is typically as the illustration of FIG. 3 to the right of reference line A—A.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A children's playground device adapted for climbing and sliding on outer surface portions thereof, comprising:

(a) a first set of four generally planar members each providing an inclined irregular outer surface adapted for climbing:

(b) a second set of four generally planar members each providing an inclined smooth outer surface adapted for sliding;

(c) connecting and mounting means removeably interconnecting and mounting said planar members in side by side relationship in a manner wherein:

(i) said planar members form removable sides of an integral structure simulating an eight-sided pyramid;

(ii) individual planar members of said first and second sets are mounted in an alternating sequence such that each said climbing surface is located between two said sliding surfaces;

(iii) each planar member of the first set is positioned on a side of said structure opposite from a side of said structure on which another planar number of the first set is positioned; and (iv) each planar member of the second set is positioned on a side of said structure opposite from a side of said structure on which another planar number of the second set is positioned.

2. A children's playground device as claimed in claim 1 wherein each of said first set of planar members are of identical size and substantially triangular in shape and each of said second set of planar members are of identical size and rectangular in shape and said planar members incline upwardly toward a common center.

3. A children's playground device as claimed in claim 1 including a horizontal top pad member located and mounted immediately adjacent respective upper edges of said planar members.

4. A children's playground device as claimed in claim 1 including a horizontal resilient bottom pad member releasably secured to said connecting and mounting means and surrounding a base portion of said structure.

5. A children's playground device as claimed in claim 1 including a horizontal top pad member located and mounted immediately adjacent respective upper edges of said planar members and a horizontal resilient bottom pad member releasably secured to said connecting and mounting means and surrounding a base portion of said structure.

6. A children's playground device as claimed in claim 1 wherein said connecting and mounting means includes a rigid three-dimensional frame on which said panel members are removably mountable.

7. A children's playground device as claimed in claim 1 wherein a selected one of said panel members is formed with releasable latching means adapted so that removal of all other panel members depends on releasing said latching means.

8. A children's playground device as claimed in claim 1 wherein selected ones of said first set of planar members are formed with a different irregular outer surface than others of said first set of panel members thereby presenting different climbing surfaces to the users of said device.

9. A children's playground device as claimed in claim 1, wherein:

(a) each of said first set of planar members are of identical size and triangular in shape and each of said second set of planar members are of identical size and rectangular in shape and said planar members incline upwardly toward a common center;

(b) said device includes a horizontal top pad member located and mounted immediately above respective upper edges of said planar members;

(c) said device includes a horizontal top pad member located and mounted immediately adjacent respective upper edges of said planar members;

(d) said device includes a horizontal resilient bottom pad member releasably secured to said connecting and mounting means and surrounding a base portion of said structure;

(e) said connecting and mounting means includes a rigid three-dimensional frame on which said panel members are removably mountable (f) a selected one of said panel members is formed with releasable latching means in a manner such that removal of all other panel members depends on releasing said latching means; and (g) selected of said first set of planar members are formed with a different irregular outer surface than others of said first set of panel members thereby presenting different climbing surfaces to the users of said device.

* * * * *

UNITED STATES PATENT AND TRADEMARK OFFICE

CERTIFICATE OF CORRECTION

PATENT NO. : 5,334,098

DATED : August 2, 1994

INVENTOR(S) : Rodney T. Pope, Steven D. Barber, Daniel R. Hall

It is certified that error appears in the above-indentified patent and that said Letters Patent is hereby corrected as shown below:

Column 4, line 51, change "number" to read --member--.

Column 4, line 56, change "number" to read --member--.

Signed and Sealed this

Eighteenth Day of October, 1994

Bruce Lehman

*Attest:*

BRUCE LEHMAN

*Attesting Officer*

*Commissioner of Patents and Trademarks*